US009523256B2

(12) United States Patent
Bilansky et al.

(10) Patent No.: US 9,523,256 B2
(45) Date of Patent: Dec. 20, 2016

(54) FOLD BACK SWELL PACKER

(71) Applicant: Schlumberger Technology Corporation, Sugar Land, TX (US)

(72) Inventors: Erik Bilansky, Pearland, TX (US); Jeff Maynard, Angleton, TX (US); Liuqing Yang, Kuala Lumpur (MY)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/650,501

(22) PCT Filed: Dec. 4, 2013

(86) PCT No.: PCT/US2013/072997

§ 371 (c)(1),
(2) Date: Jun. 8, 2015

(87) PCT Pub. No.: WO2014/089150

PCT Pub. Date: Jun. 12, 2014

(65) Prior Publication Data

US 2015/0308214 A1 Oct. 29, 2015

Related U.S. Application Data

(60) Provisional application No. 61/734,656, filed on Dec. 7, 2012, provisional application No. 61/735,910, filed on Dec. 11, 2012.

(51) Int. Cl.

| | |
|---|---|
| ***E21B 33/12*** | (2006.01) |
| ***E21B 33/127*** | (2006.01) |
| *E21B 23/06* | (2006.01) |

(52) U.S. Cl.
CPC ..... *E21B 33/127* (2013.01); *E21B 33/1208* (2013.01); *E21B 33/1216* (2013.01); *E21B 23/06* (2013.01)

(58) Field of Classification Search
CPC ..... E21B 33/1208; E21B 33/1216; E21B 33/1277; E21B 33/127
See application file for complete search history.

(56) References Cited

U.S. PATENT DOCUMENTS

| | | | |
|---|---|---|---|
| 3,215,205 | A | 11/1965 | Sizer |
| 7,055,829 | B2 | 6/2006 | Russell |
| 7,708,080 | B2 | 5/2010 | Conaway et al. |

(Continued)

FOREIGN PATENT DOCUMENTS

| | | |
|---|---|---|
| EP | 2246522 A3 | 1/2013 |
| GB | 2427420 B1 | 7/2008 |

(Continued)

*Primary Examiner* — Giovanna C Wright
*Assistant Examiner* — Kristyn Hall
(74) *Attorney, Agent, or Firm* — David J. Groesbeck

(57) ABSTRACT

A fold back ring for a swell packer is disclosed. A swell packer has a support member, a swellable element coupled to the support member, and a fold back ring coupled to the support member and engaging the swellable element. The fold back ring is sized and positioned such that when the swellable element swells, the fold back ring flexes outwardly and is caught between the swellable element and the interior surface of the well. The fold back ring therefore forms a barrier against extrusion of the swellable element.

15 Claims, 5 Drawing Sheets

(56) References Cited

U.S. PATENT DOCUMENTS

| | | | | |
|---|---|---|---|---|
| 7,938,176 | B2 | 5/2011 | Patel | |
| 2006/0243457 | A1 | 11/2006 | Kossa et al. | |
| 2009/0255690 | A1* | 10/2009 | Conner | E21B 33/1216 166/387 |
| 2010/0038074 | A1* | 2/2010 | Patel | E21B 33/1216 166/187 |

FOREIGN PATENT DOCUMENTS

| | | | |
|---|---|---|---|
| GB | 2458557 | B1 | 7/2010 |
| GB | 2469870 | A1 | 11/2010 |
| WO | 2006121340 | A1 | 11/2006 |
| WO | 2008062186 | A1 | 5/2008 |

* cited by examiner

FOLD BACK SWELL PACKER

BACKGROUND

This section provides background information to facilitate a better understanding of the various aspects of the disclosure. It should be understood that the statements in this section of this document are to be read in this light, and not as admissions of prior art.

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. One piece of equipment which may be installed is the swell packer. Swellable packers such as RESPACK™, SWELLPACKER®, REPACER™, DYNAFORM™, SWELLRIGHT™, FREECAP® and so forth are widely used in the oil and gas industry for many applications. For example swell packers may be used for ICD compartmentalization, multistage fracturing, gravel packing with shunt tubes, straddle assemblies, cement replacement or cement assurance.

Instead of requiring a complex setting mechanism with moving parts such as in regular cased- or open-hole packers (non-swellable), the swellable packer "setting" mechanism is that of thermodynamic absorption or osmosis of wellbore fluid, either hydrocarbons or water into the swellable elastomeric element. Specifically, swell packers generally include a sealing material that expands or swells when it comes into contact with wellbore fluids such as hydrocarbon or brine. The applications of swell packers may be limited by a number of factors including their capability of increasing in volume, their ability to create a seal, and their mechanical properties in their un-swollen and swollen states. When a swell packer is exposed to high pressure differentials downhole, the integrity of the annular seal created by a swell packer should be maintained. Since the mechanical strength of the sealing material generally decreases after expanding and swelling, the tendency of the swellable material to extrude, deform, or flow under forces from the pressure differential will be increased, resulting in a potential failure mode between the packer and the surrounding surface.

FIGS. 1*a*, 1*b*, and 1*c* illustrate a conventional swell packer 10 including a swellable element 12 surrounding a portion of a tubing 14 and placed within a well with the swellable element 12 exposed to the walls of the well. In this case the walls of the well are a casing 16. At both axial extremes of the swellable element 12 are gauge rings 18 that support the swellable element 12 on the tubing 14. Prior to swelling, the swell packer element is typically protected by the gage rings to avoid damages during run in hole ("RIH"). FIG. 1*b* shows the packer 10 after contact with a hydrocarbon or water-based wellbore fluid and the swellable element 12 has swollen to contact the casing 16 or other wellbore inner surfaces in order to develop an annular seal. The swelling pressure in the swellable element 12 can cause it to expand over the gauge rings 18. FIG. 1*c* illustrates the swell packer 10 subject to a differential pressure with a higher pressure in the space 20 above the packer 10 the space 22 below the packer 10, causing the swellable element 12 to extrude toward the low pressure side. The deformation in the swellable element 12 can reach severe levels and cause tearing which results in reduced performance. The extruded swellable element 12 can even segregate from the bulk of the packer components. Accordingly, the pressure sealing capability of the swell packer element is jeopardized and undermined by the extrusion. In some cases, when the extrusion is not contained, a "tunnel" may be created along the axial direction of the element causing the swell packer to fail to hold any differential pressure.

SUMMARY

Embodiments of the present disclosure are directed to a swell packer including a support member having a generally cylindrical profile, and a swellable element positioned around the support member and in contact with the support member. The swellable element has a first axial end, a second axial end, and a radially outward surface configured to engage a portion of a well wall when sufficiently swollen. The swell packer also has first and second gauge rings on the support member. The first gauge ring is adjacent the first axial end of the swellable element and the second gauge ring is adjacent the second axial end of the swellable element. The swell packer also includes first and second fold back rings. The first fold back ring is between the first gauge ring and the first axial end of the swellable element and the second fold back ring is between the second gauge ring and the second axial end of the swellable element. The fold back rings are configured to flex outwardly as the swellable element swells. When the swellable element expands to contact the well wall, a portion of the first fold back ring is radially between the first axial end and the well wall and a portion of the second fold back ring is radially between the second axial end and the well wall.

In other embodiments the present disclosure is directed to a swell packer including a support member, and a swellable element surrounding a portion of the support member and configured to react to a swelling fluid to swell and contact an internal wall of a well. The swellable element has an axial end. The swell packer also has a fold back ring with an interior circumference bonded to the support member and an exterior circumference opposite the interior circumference. The exterior circumference has recesses formed therein that enable the fold back ring to flexibly expand as the swellable element swells. The fold back ring is positioned adjacent to the swellable element covering the axial end of the swellable element. The fold back ring is configured to expand to contact the internal wall of the well when the swellable element expands.

In yet further embodiments, the present disclosure is directed to a method of mitigating extrusion of a swellable element of a swell packer. The method includes forming a swellable element for a swell packer to substantially surround a support member, and forming a fold back ring over a portion of the swellable element. The fold back ring is flexible and permits the swellable element to expand. The method also includes swelling the swellable element sufficiently to deflect the fold back ring outwardly and against an interior surface of a well. The fold back ring is sufficiently large that at least a distal portion of the fold back ring is caught between the swellable element and the interior surface of the well to prevent extrusion of the swellable element.

BRIEF DESCRIPTION OF THE DRAWINGS

Embodiments of sequential steam injection and production completions are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1A:
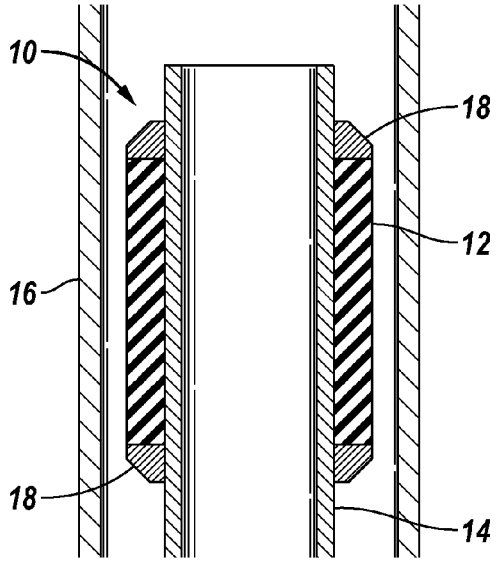
FIG. 1A (Prior Art)
FIGS. 1*a*, 1*b*, and 1*c* illustrate a conventional swell packer including a swellable element without anti-extrusion means.
Figure 1B:
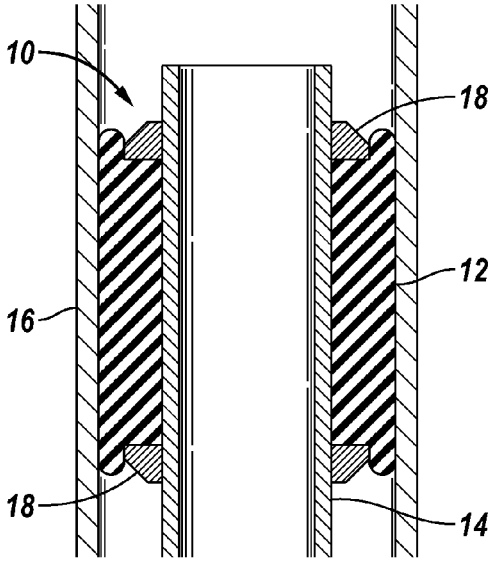
FIG. 1B (Prior Art)
Figure 1C:
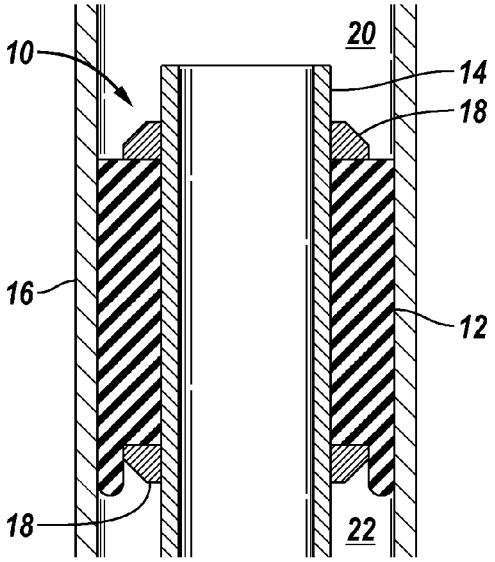
FIG. 1C (Prior Art)

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect," "connection," "connected," "in connection with," and "connecting" are used to mean "in direct connection with" or "in connection with via one or more elements"; and the term "set" is used to mean "one element" or "more than one element". Further, the terms "couple," "coupling," "coupled," "coupled together," and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

Figure 2:
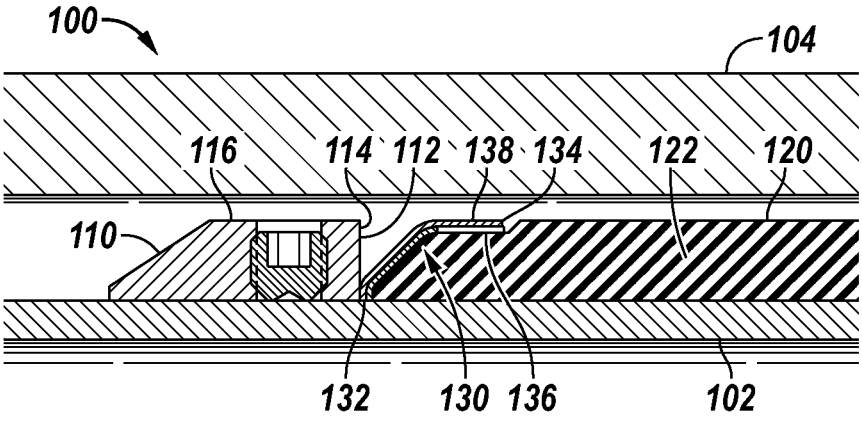
FIG. 2 is a cross-sectional view of a swell packer according to embodiments of the present disclosure.
Figure 3:
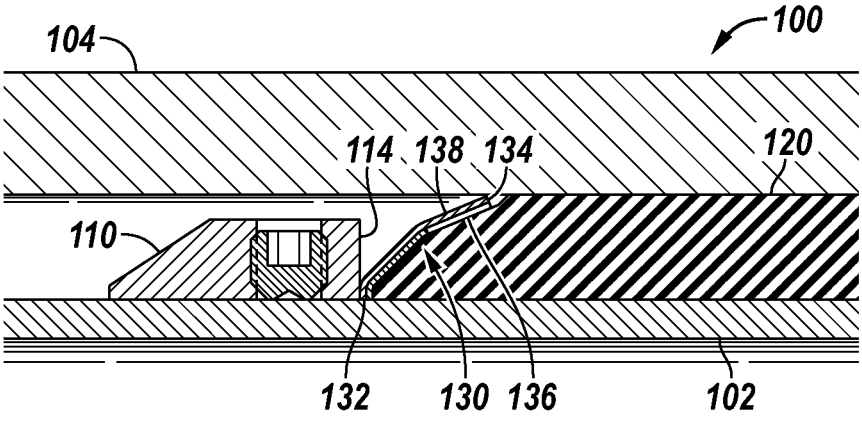
FIG. 3 shows the swell packer of the present disclosure after the swelling fluid has been introduced and the swellable element has begun to swell.
Figure 4:
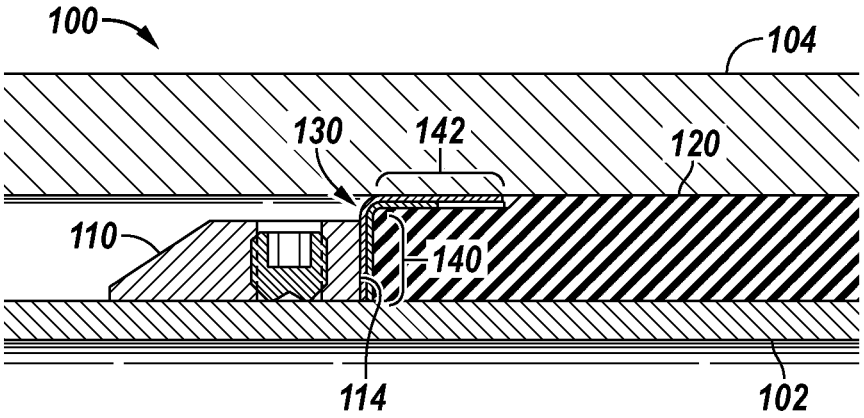
FIG. 4 shows the swellable packer of the present disclosure at a still further advanced stage of swelling.

FIG. 2 is a cross-sectional view of a swell packer 100 according to embodiments of the present disclosure. The swell packer 100 includes a gauge ring 110, a swellable element 120, and a fold back ring 130. The swell packer 100 is positioned around a section of tubing 102, and is shown in a well surrounded by walls 104 of a well. The walls can be a casing or an open-hole rock formation, or any other down hole interior surface. The gauge ring 110 has an element-side face 112, a shoulder 114, and top side 116. Another gauge ring (not shown) can be positioned at the other end of the swellable element 120. The second ring can be identical, substantially similar, or different from the gauge ring 110. The element-side face 112 has a flat surface oriented toward the swellable element 120. The shoulder 114 is a right-angle corner of the gauge ring 110 adjacent to the element-side face 112. The top side 116 is adjacent the shoulder 114 and is generally parallel with the surface of the tubing 102 and the well walls 104. The swellable element 120 is positioned adjacent the gauge ring 110 such that the gauge ring 110 supports the swellable element 120 on the tubing 102. For purposes of brevity and ease of explanation, FIGS. 2-4 illustrate a single axial end of the packers of the disclosed embodiments. The components of the packers at each end may be identical, or they may vary in any suitable manner according to the present disclosure.

The fold back ring 130 is positioned between the gauge ring 110 and the swellable element 120. The fold back ring 130 has an inner extent 132 and an outer extent 134. The inner extent 132 contacts the tubing 102 and, in some cases, is fixedly attached to the tubing 102. The fold back ring 130 flares radially outward from the inner extent 132 to the outer extent 134 and extends axially toward the swellable element 120. The fold back ring 130 forms a cup-like shape which holds a portion of the swellable element 120 between the fold back ring 130 and the tubing 102. The swellable element 120 can be formed to fit between the fold back ring 130 and the tubing 102, or it can be resiliently or swellably deformed to fit within the space between the fold back ring 130 and the tubing 102. At the outer extent 134 the ring 130 and the outer surface of the swellable element 120 are generally parallel, either because of the shape of the swellable element 120 matching the shape of the ring 130, or because the ring 130 resiliently contains a portion of the swellable element 120. The ring 130 is formed of two layers of material, an inner layer 136, and an outer layer 138. These layers can be made of the same material, such as steel or brass, or they can be made of different materials, such as the outer layer 138 of steel and the inner layer 136 of brass or vice versa. The inner and outer layers have substantially the same shape with the outer layer 138 contacting the inner layer 136, which in turn contacts the swellable element 120. The layers 136, 138 can be fixed together by an adhesive or weld or can be simply formed together without a direct fastening mechanism between them.

The fold back ring 130 holds the ends of the swellable element 120 radially inward and away from the casing 104. This protects the swellable packer 100 from damage during RIH. Once the swellable packer 100 is in position in the well a swelling fluid is delivered to the swellable element 120 which reacts with the fluid and swells to engage the casing 104. The fold back ring 130 allows the swelling fluid to reach a middle portion 122 of the swellable element 120 before the end of the swellable element 120, partially covered by the fold back ring 130, from expanding rapidly and sealing to the casing and thus preventing further swelling fluid from reaching the middle portion 122. The swellable element 120 therefore swells from the middle to the ends when brought into contact with the swelling fluid, rather than at the ends first.

FIG. 3 shows the swell packer 100 of the present disclosure after the swelling fluid has been introduced and the swellable element 120 has begun to swell, causing the fold back ring 130 to deform and expand to contact the casing 104. The fold back ring 130 can be made of steel or brass or another suitable material having appropriate modulus to permit this flexure. Observable in the Figure is the change in angle of the fold back ring 130 as the swelling continues. The outer extent 134 is now no longer parallel with the tubing, and only the extreme end has contacted the casing 104.

FIG. 4 shows the swellable packer 100 of the present disclosure at a still further advanced stage of swelling. The swellable element 120 has deformed the fold back ring 130 such that it has an L-shape, with a radial arm 140 extending radially away from the tubing 102 and an axial arm 142 extending generally parallel with the casing 104. The fold back ring 130 and swellable element 120 are now pressing against the casing with sufficient pressure to hold the packer 100 in place and to withstand a differential pressure from above or below the packer 100. The radial arm 140 contacts the element side 112 of the gauge ring 110. The fold back ring 130 has sufficient length to provide an adequate seal against the casing 104. In this embodiment the axial arm is slightly longer than the radial arm. The dimensions of a given well, casing, and packer will dictate the precise dimensions of the swellable element 120 and fold back ring 130. The fold back ring 130 resists the extrusion effects described above experienced by such swellable packers without such a ring.

Figure 5:
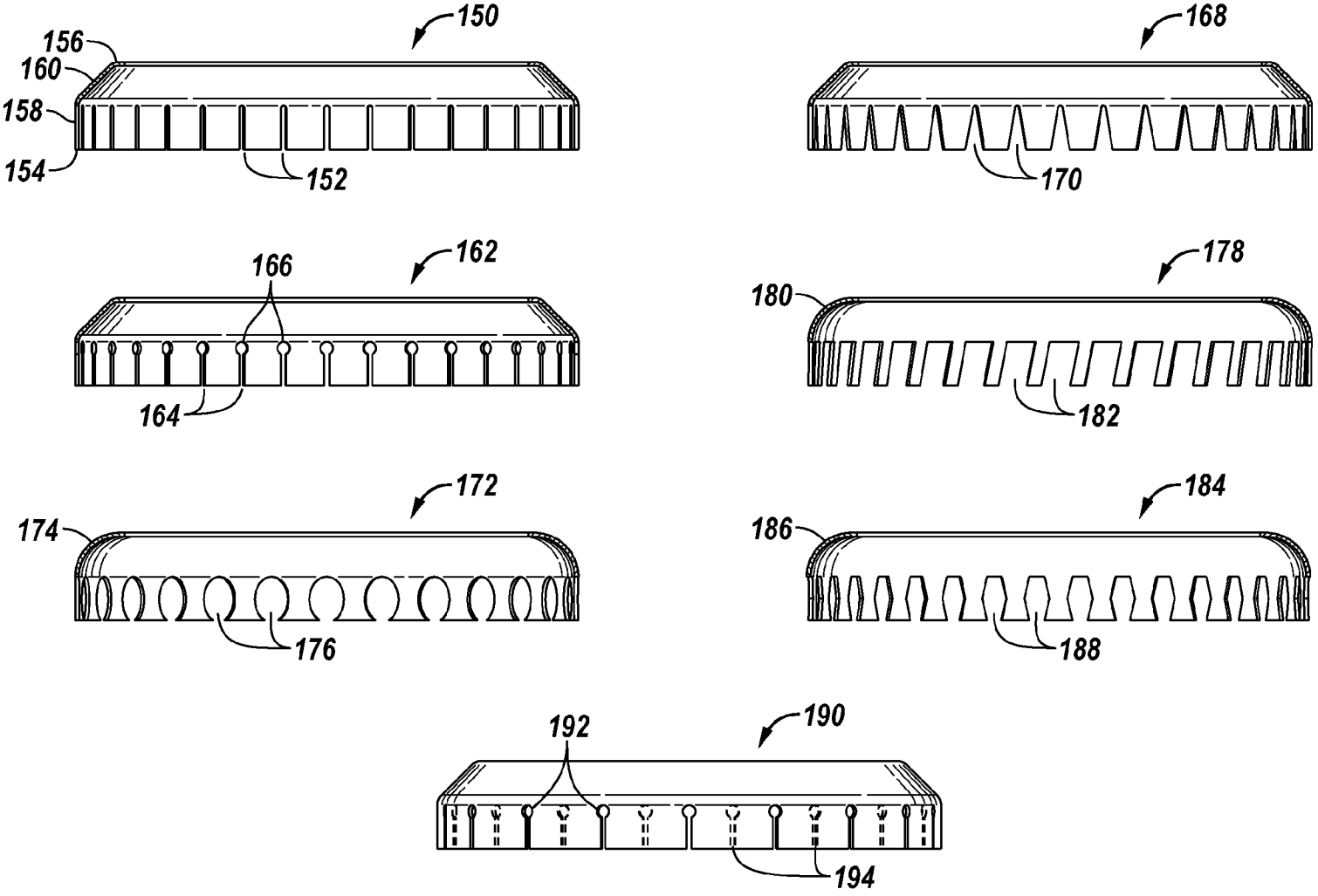
FIG. 5 illustrates seven shape configurations of the fold back ring of the present disclosure.

FIG. 5 illustrates seven shape configurations of the fold back ring 130 of the present disclosure. Each of the embodiments shown has perforations or slits formed in the ring that enable it to flex under pressure from the swelling action of the swellable element. According to a first embodiment, a fold back ring 150 has straight slits 152 extending from an outer end 154 and reaching substantially halfway to the inner end 156. The fold back ring 150 has a straight portion 158 and an angled portion 160. According to a second embodiment, a fold back ring 162 has a similar shape as the first embodiment and includes slits 164 similar to the slits 152 from the first embodiment. Each slit 164 has a circular void 166 at its deepest end. This shape can mitigate stress concentrations and may further facilitate flexure. In a third embodiment, a fold back ring 168 can have an overall shape similar to the first two embodiments. This fold back ring 168 includes slits 170 having a V-shape.

In a fourth embodiment, a fold back ring 172 has a rounded corner 174 and oval slits 176. The oval slits 176 reach just to the extreme end of the fold back ring 172 so that the ends of the fold back ring 172 can expand when flexed by the swellable packer. In a fifth embodiment, a fold back ring 178 has a rounded corner 180 and rhomboid, or parallelogram-shaped, slits 182. In a sixth embodiment, a fold back ring 184 can include a rounded corner 186 and diamond-shaped slits 188. The features described herein are generally interchangeable. Any of the slit shapes can be used with angled corner or a rounded corner, for example. In addition, the slits of a given fold back ring can have different shapes. For example, some of the slits can be straight and some can be oval, diamond, V-shape, or any other suitable shape. The fold back rings and shapes described can apply to the inner or outer layer. The overall shape of the inner and outer layers (e.g., angled or rounded corner) should match; however the slit shapes need not necessarily match. In some embodiments the inner layer has straight slits and the outer layer has oval shaped slits. Any suitable permutation is possible. In addition, some embodiments feature three or more layers to form the complete fold back ring.

The inner and outer layers are positioned such that their respective slits are out of phase as shown in the fold back ring 190 according to a seventh embodiment. The fold back ring 190 includes slits 192 in the outer layer and slits 194 in the inner layer, shown in phantom because the outer layer covers them from view. The slits 194 and 196 can have the same circumferential spacing, such that when they are sufficiently out of phase no two slits overlap. The completed fold back ring completely covers the swellable element, thereby preventing any extrusion path through the fold back ring. The dual-layer design permits the use of slits which increase flexibility of the completed ring without creating an extrusion path through the fold back ring.

Figure 6A:
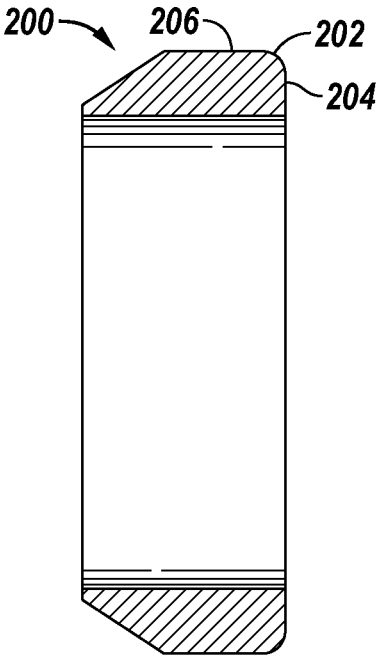
FIGS. 6*a* and 6*b* are cross-sectional views of a gauge rings according to embodiments of the present disclosure.
Figure 6B:
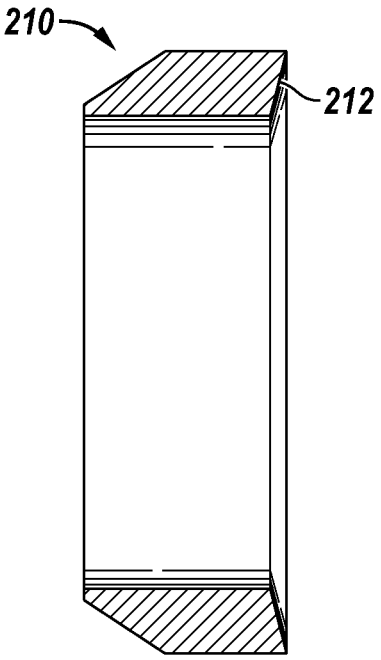

FIGS. 6*a* and 6*b* are cross-sectional views of a gauge rings 200 and 210, respectively, according to embodiments of the present disclosure. The first gauge ring 200 has a rounded shoulder 202 between an element side 204 and a top side 206 of the gauge ring 200. The rounded shoulder 202 can mitigate stress concentrations that may arise when the swellable element has swollen and presses the fold back ring (not shown) against the element side 204. The second gauge ring 210 has an element side 212 that is angled toward the fold back ring (not shown) such that when the swellable element is swollen the angle of the fold back ring is less than 90 degrees, lessening the strain on the fold back ring when fully deployed.

Figure 7A:
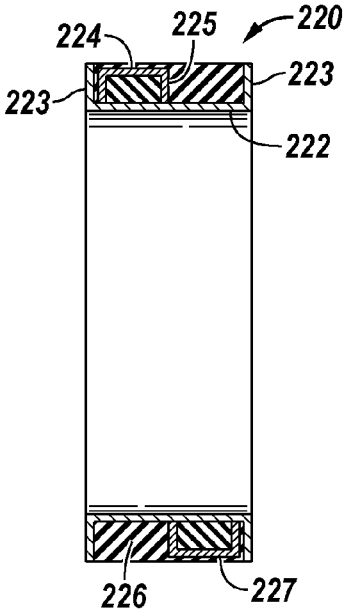
FIGS. 7*a* and 7*b* are side and axial cross-sectional views, respectively, of a gauge ring according to embodiments of the present disclosure.
Figure 7B:
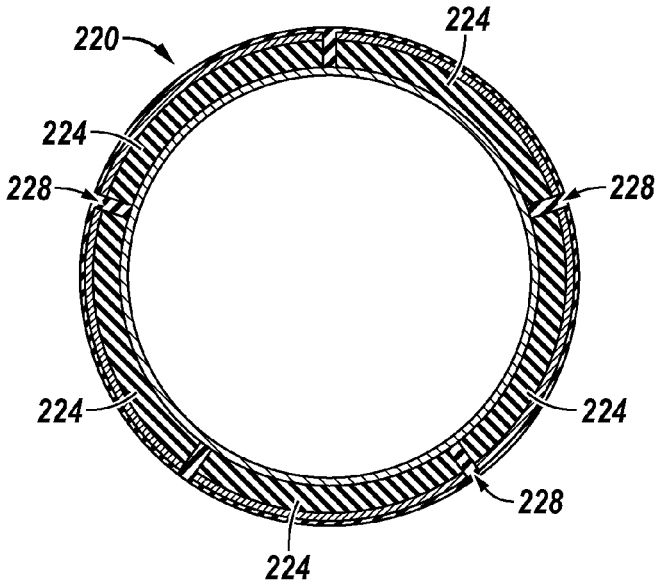

FIGS. 7*a* and 7*b* are a side cross sectional view and an end cross sectional view, respectively, of a gauge ring 220 according to further embodiments of the present disclosure. Gauge rings are traditionally used to protect the swelling element while run in hole. Unfortunately, the gap between the outside diameter of the gauge ring and the interior diameter of the casing or open hole forms a path for the swelling element to extrude through. The fold back ring and general construction of the present disclosure closes this gap and therefore mitigates or eliminates extrusion. The gauge ring 220 has an inner ring 222 and an outer ring 224, both of which are surrounded by swellable rubber 226. The outer and inner rings are made of a rigid material, such as metal. The inner ring 222 has a U-shaped cross section with radially-outwardly extending flanges 223. The outer ring has a similar, but smaller, shape, and is inverted relative to the inner ring, with radially-inwardly extending flanges 225 extending toward the inner ring 222. The swellable material fills the inner ring 222 and surrounds the outer ring 224. Turning to FIG. 7*b*, the inner ring 222 can extend around the circumference of the gauge ring 220, but the outer ring 224 is made up of multiple sections—in this case, five sections. The multiple sections can be offset axially and arranged out of phase with one another. As shown in FIG. 7*a*, an outer ring 227 is displaced axially relative to the first outer ring 224. There is a small gap 228 between each section that is filled with swellable rubber (or another suitable swellable material). The second outer ring 227 (refer again to FIG. 7*a*) is out of phase with the first rings 224 such that the gaps 228 are covered by the second group of outer rings. The inner and outer rings provide strength and support to the gauge ring without significantly adding to the outer diameter of the packer. When deployed, the swellable rubber expands and presses the outer ring sections outward into a sealing engagement with a casing or other well wall. The outer sections provide added rigidity to the gauge ring and prevent extrusion of the swellable material.

Figure 8:
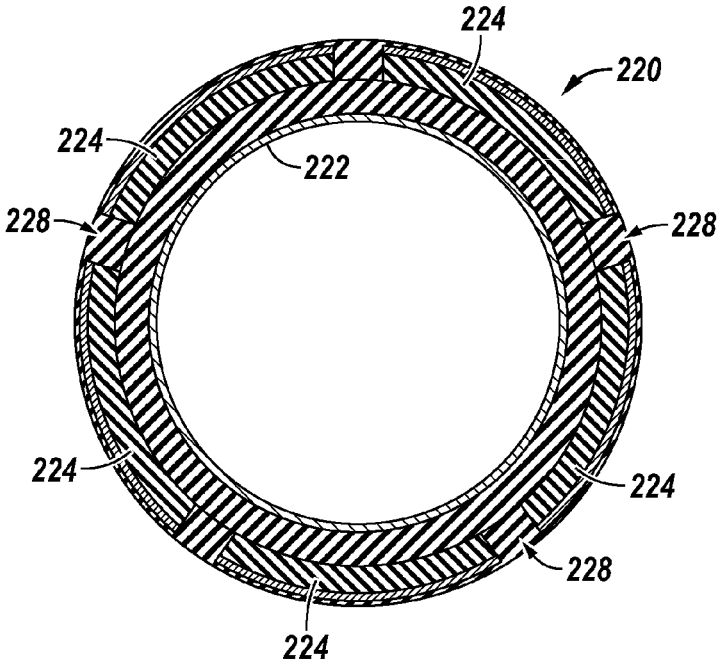
FIG. 8 is an axial cross-sectional view of the gauge ring of FIGS. 7*a* and 7*b* after swelling.

FIG. 8 illustrates the gauge ring 220 of FIGS. 7*a* and 7*b* in a swollen state. The inner ring 222 remains in place, but the outer rings have expanded outwardly into sealing engagement with a casing or well wall. In this depicted embodiment the gauge ring 220 has expanded radially by approximately the dimension of the flanges 225 (shown to greater advantage in FIG. 7*a*). In this configuration the flanges of the inner and outer rings overlap at least partially, providing a barrier to extrusion.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

What is claimed is:

1. A swell packer, comprising:

a support member having a generally cylindrical profile;

a swellable element positioned around the support member and in contact with the support member, the swellable element having a first axial end, a second axial end, and a radially outward surface configured to engage a portion of a well wall when sufficient swollen;

first and second gauge rings on the support member, wherein the first gauge ring is adjacent the first axial end of the swellable element and the second gauge ring is adjacent the second axial end of the swellable element, wherein at least one of the gauge rings comprises a swellable element and a plurality of rigid ring sections embedded within the swellable element, wherein swelling of the swellable element causes the rigid ring sections to expand radially; and first and second fold back rings, wherein the first fold back ring is between the first gauge ring and the first axial end of the swellable element and the second fold back ring is between the second gauge ring and the second axial end of the swellable element, wherein the fold back rings are configured to flex outwardly as the swellable element swells, and, wherein when the swellable element expands to contact the well wall a portion of the first fold back ring is radially between the first axial end and the well wall and a portion of the second fold back ring is radially between the second axial end and the well wall.

2. The swell packer of claim 1 wherein when the fold back rings are fully expanded they have an L-shaped cross section including a radial portion extending from the support member to the well wall and an axial portion extending generally parallel with the well wall.

3. The swell packer of claim 1 wherein the fold back rings comprise an internal layer contacting the swellable element and an external layer contacting the internal layer, each layer being solid at the support member side and having slits in an opposite side.

4. The swell packer of claim 3 wherein the slits in the internal layer are out of phase with the slits in the external layer such that no portion of the swellable element is exposed through the fold back rings.

5. The swell packer of claim 1 wherein the fold back rings have a first end bonded to the support member and a second end opposite the first end, wherein the second end is free and is folded over the axial ends of the swellable element.

6. The swell packer of claim 1 wherein the fold back rings have two or more layers, wherein both layers are of the same material.

7. The swell packer of claim 1 wherein the fold back rings have two or more layers, wherein at least two adjacent layers are made of different materials.

8. The swell packer of claim 1 wherein the fold back rings are made of steel or brass.

9. The swell packer of claim 1 wherein the fold back rings have a first end bonded to the support member and a second end opposite the first end, wherein the second end is free and has slits formed therein.

10. The swell packer of claim 9 wherein the slits are at least one of straight, circular, Vshaped, parallelogram, diamond, or oval.

11. The swell packer of claim 1 wherein at least one of the rigid ring sections has a Ushaped cross-sectional profile defining an interior region, and wherein the swellable element substantially fills the interior region.

12. A swell packer, comprising:

a support member;

a swellable element surrounding a portion of the support member and configured to react to a swelling fluid to swell and contact an internal wall of a well, wherein the swellable element has an axial end;

a fold back ring having an interior circumference bonded to the support member and an exterior circumference opposite the interior circumference, wherein the exterior circumference has recesses formed therein that enable the fold back ring to flexibly expand as the swellable element swells, wherein the fold back ring is positioned adjacent to the swellable element covering the axial end of the swellable element, and wherein the fold back ring is configured to expand to contact the internal wall of the well when the swellable element expands; and a gauge ring having a swellable element and one or more rigid ring sections at least partially embedded within the swellable element.

13. The swell packer of claim 12 wherein, before the swellable element swells, the fold back ring is positioned over the axial end of the swellable element and resiliently compresses the axial end of the swellable element.

14. The swell packer of claim 12 wherein the fold back ring is wider than the distance between the support member and the internal wall of the well, such that when the swellable element expands a portion of the fold back ring is caught between the swellable element and the interior wall of the well.

15. The swell packer of claim 12 wherein the gauge ring has five rigid ring sections spaced radially around the support member with gaps between the rigid ring sections, wherein the gaps are filled by the swellable element of the gauge ring, and wherein when the swellable element of the gauge ring swells the rigid ring sections expand radially away from the support member.

* * * * *